US008552856B2

(12) United States Patent
McRae

(10) Patent No.: US 8,552,856 B2
(45) Date of Patent: Oct. 8, 2013

(54) LOW BATTERY REMOTE DISPLAY SYSTEM

(75) Inventor: Matthew McRae, Irvine, CA (US)

(73) Assignee: Vizio Inc., Irvine, CA (US)

( * ) Notice: Subject to any disclaimer, the term of this patent is extended or adjusted under 35 U.S.C. 154(b) by 204 days.

(21) Appl. No.: 13/075,156

(22) Filed: Mar. 29, 2011

(65) Prior Publication Data

US 2012/0249323 A1 Oct. 4, 2012

(51) Int. Cl.
*G08B 1/08* (2006.01)

(52) U.S. Cl.
USPC ..... 340/539.11; 320/132

(58) Field of Classification Search
USPC ..... 340/539.11; 320/132; 348/730
See application file for complete search history.

(56) References Cited

U.S. PATENT DOCUMENTS 6,694,471 B1 * 2/2004 Sharp ..... 714/749
2003/0052648 A1 * 3/2003 Hara et al. ..... 320/132
2010/0321587 A1 * 12/2010 Kerofsky ..... 348/730

* cited by examiner

*Primary Examiner* — Shirley Lu
(74) *Attorney, Agent, or Firm* — Law Office of Scott C. Harris, Inc.

(57) ABSTRACT

A mobile device, e.g. a remote control, that communicates with a remote device. The device is controlled by a battery providing power for electronic circuits and components contained within the hand held remote control device. A battery monitoring device measures the voltage of the battery. A memory device saves the data generated by the battery monitoring device indicating the voltage of the battery. A transmission device transmits a notification to the display device when the voltage of the battery decreases to some predetermined level. The display device may receive the notification of a low battery from the hand held device. An application contained within the display device or the remote control displays a visual indication on the display device to the user indicating that the battery in the hand held device is low and requires recharging.

13 Claims, 2 Drawing Sheets

LOW BATTERY REMOTE DISPLAY SYSTEM

BACKGROUND

Portable electronic devices have been used to communicate with a main device. For example, a hand-held remote may be used to control a television or personal computer.

Other applications of battery-operated devices exist which communicate with remote devices which are capable of display.

Mobile devices, such as media players, may also so communicate.

Some devices, such as conventional remote controls, simply have no display on them. This makes it difficult or impossible to convey to a user that the battery level on the remote control is approaching a critical level.

SUMMARY

The present application describes a system, method, and apparatus for notification to a user that the charge state or remaining energy capacity of the battery powering a mobile device is low or approaching a non-usable level. According to an embodiment, the notification is carried out on a separate unit from the mobile device.

In one embodiment the mobile device is a remote control.

BRIEF DESCRIPTION OF THE DRAWINGS in the drawings.

DETAILED DESCRIPTION

Figure 1:
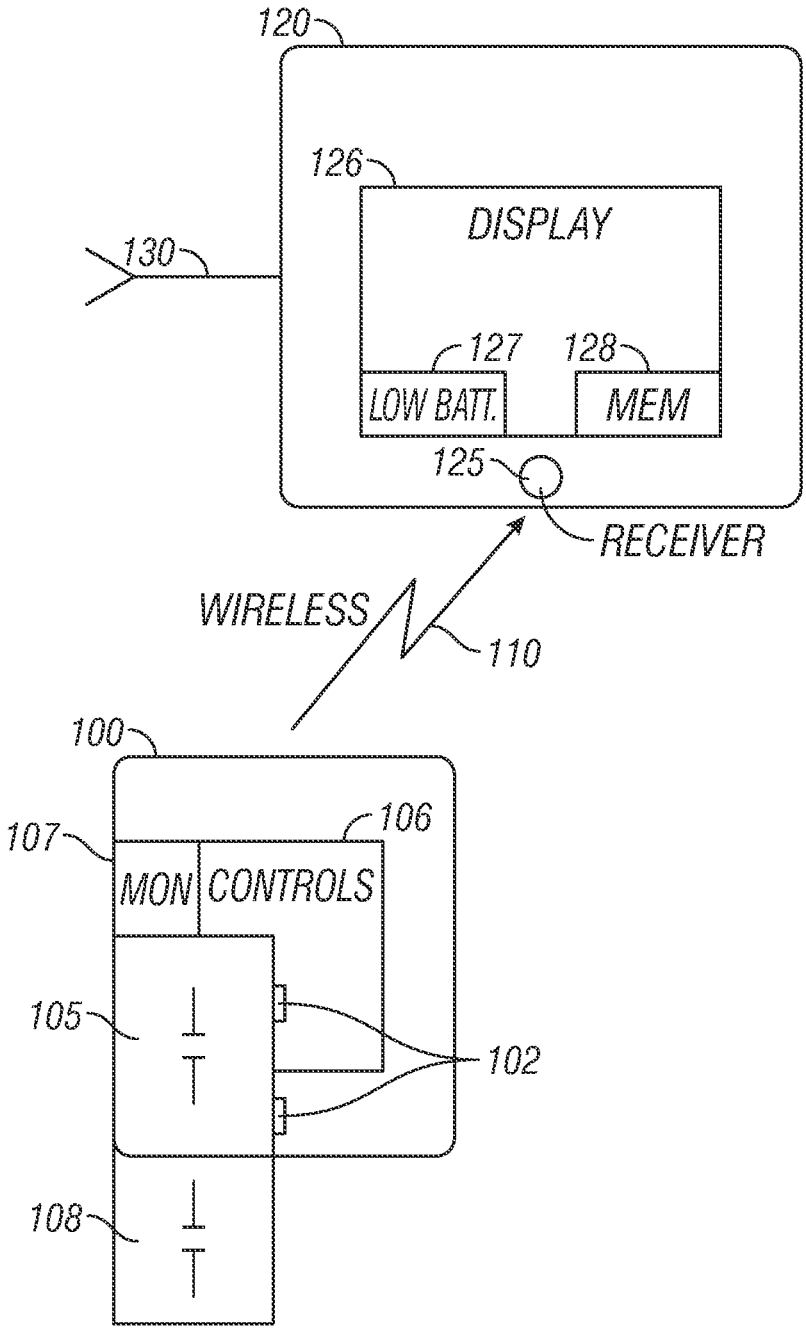
FIG. 1 shows a system diagram.

FIG. 1 shows an embodiment. A mobile hand-held device 100, which in this embodiment may be a remote control, produces a wireless output 110. The wireless output is also received and interpreted by a controlled device 120. In this embodiment, the controlled device 120 can be a television that receives the wireless remote control commands.

The wireless control 110 can be any wireless command, such as an RF or infrared channel. The RF channel can be Bluetooth, 802 11 WiFi or other wireless frequency. Any wireless signal, including RF, optical, and all others can be used for this purpose.

The remote control itself includes a battery 105 that is connected to a battery connection, e.g., contacts 102, in the mobile device. The battery runs a number of circuits within the remote control, shown generically as electronic controls 106. The controls can also include and/or control a user interface, for example, which accepts commands. The user can for example enter a channel number and other information on the remote control that is transmitted via the wireless control 110. The remote control also includes a battery monitor 107 which monitors a condition of the battery. Either the remote device 100, or the controlled device 120 may operate a program that determines the level of the battery. The program may be as simple as detecting a voltage which is low enough that indicates that the device can no longer consistently operate, or needs to be changed in some way.

In the embodiment, the controlled device, here the television, receives the wireless signal on a receiver 125. As conventional, the television can also receive program information to be displayed via a program input 130. The for example the program input 130 can be a network connection, a connection to a cable supplier, satellite, or antenna connection. The television displays content depending on what is received over the connection.

One of the operations from the wireless signal 110 is to change what is being displayed on the display 126. For example, the wireless control 110 may be operated to change the channel. Another operation, however, is that the level of the battery monitored by the monitor 107 is transmitted to the controlled device. In the embodiment, a low battery indication 127 may be displayed on the screen 126 of the television 120.

Unlike other systems, this system therefore displays information about the charge level of the battery of the controller on the controlled device, where that controlled device that is remote from the controller.

Different aspects of these embodiments are described herein.

In an embodiment, the mobile device is a hand held remote control device normally used to send commands and data wirelessly to a television over a RF or IR channel. This device will monitor the voltage of the battery providing power to the hand held remote control device. When the battery monitor detects that the voltage of the battery has decreased or has become lower than some predetermined voltage, a low battery command and/or data will be transmitted to the display device. Transmission of the battery level may be different for different communications links. For example, if the communications link is via RF (BlueTooth, 802.11 WiFi, or other RF), the notification may be sent asynchronously at the time the battery level is noted by the hand held remote control device. If the communications link is via IR, the notification may be sent the next time the hand held remote control device is used to send a command to the display device.

The differences in transmission methods include the following:

RF: The notification is sent to the display device at the time the battery condition is detected. For this scenario, the battery powered device could be residing on a coffee table, in a drawer, or on the person using the device.

IR: The notification is sent to the display device some time after the low battery condition is detected. For this scenario the battery powered device will send the battery level notification to the display device the next time the user sends a command to the display device.

According to another embodiment, as described above, the sending of the low battery signal may occur at any time, including at a time when the television is not displayed. According to an embodiment, the television includes a memory part 128 which may be the same memory that is used for other functions of the television. The memory stores an indication of the low battery, providing the system with the capability of remembering the low battery notification if the display device is not currently in a display mode. If this is the case, the application will display the warning at some time after the display device becomes active.

In one embodiment, the battery powered device has multiple batteries 105 and 108. In this embodiment, the battery with the lowest voltage is the battery used to determine when to send the notification.

In another embodiment, the communications channel between the battery powered device and the display device is RF. The RF link may be bidirectional or unidirectional. The notification of a low battery will be sent to the display device at some periodic rate until the battery has been recharged or replaced. In the case where the communications channel is bi-directional, the notification of a low battery will be sent to the display device at some periodic rate until the display device notifies the battery powered device that the notification has been received.

In another embodiment the device receiving the low battery notification may not be a display device. In this embodiment, the notification to the user may be a visual indicator such as a warning light on a panel or may be an audio indicator such as a beeping sound generated by a sound generator in the device or a sound sent to a speaker. In the case where a sound generator is used to generate a notification, the notification may be a tone or a voice notification that is generated speech, synthesized speech, or sampled speech. In this embodiment, however, the low battery notification is still received and communicated to the user via separate device from the mobile device itself.

In one embodiment, the battery powered device is a hand held remote control device for any consumer electronics devices such as, but not limited to, televisions, audio systems in a user's residence or automobile, or other devices such as fans, security systems, and other remote controllable devices.

In another embodiment, the battery powered device is a PDA or cell phone. In an alternate embodiment of this embodiment, the battery powered device may include a wireless RF headset and the display device is a PDA, cell phone, or smart phone.

In another embodiment, the battery powered device is a set of headphones receiving an audio stream.

In another embodiment, the battery powered device is a 3D eyeglasses device for viewing 3 dimensional displays.

In another embodiment, the display devices is a television, desktop computer, netbook, laptop, PDA, cell phone or Smart Phone, electronic picture frame, microwave oven, or other electronic device capable of communication with the battery powered device.

In another embodiment, the display device may compute the remaining time the battery powered device can operate and display that information to the user.

Figure 2:
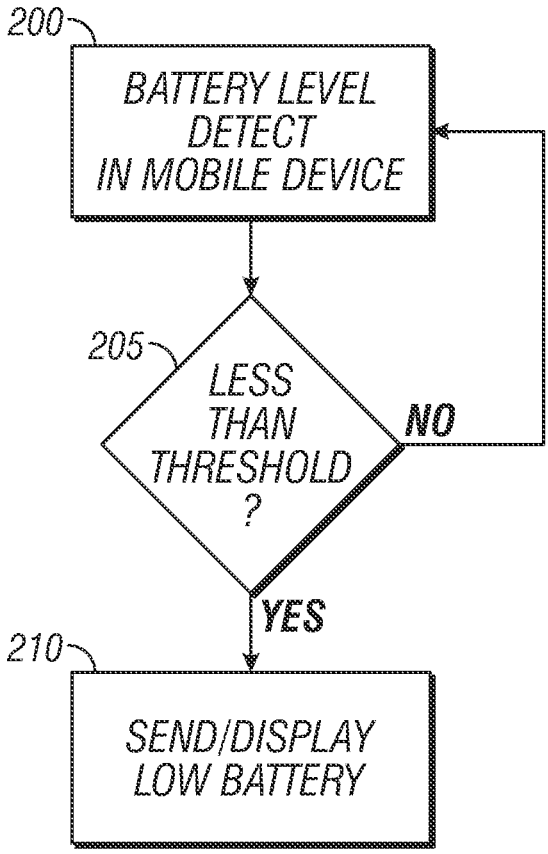
FIG. 2 shows a flowchart of operation of a program running in the processor.

According to an embodiment, a processor and the mobile device 100 (which can be part of the controls 106) and/or the processor in the television monitor 120, may carry out the flowchart shown in FIG. 2. At 200, the battery level is detected in them mobile device. This may be done by a battery level detector, such as 107. This can be a voltage detector as described above, or can be a current sensor that integrates the current flow level. At 205, the determination is made as to whether this battery level is less than the threshold. The threshold may be a level below which consistent operation of the handheld device may no longer be possible. If the battery level is less than a threshold at 205, the low battery indication is either sent or displayed at 210.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example other mobile devices can be controlled and monitored in this way. The controlled device is described as being a television, but any remote device can be used according to this system.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has a user interface port that communicates with a user interface, and which receives commands entered by a user, has at least one memory (e.g., hard drive or other comparable storage, and random access memory) that stores electronic information including a program that operates under control of the processor and with communication via the user interface port, and a video output that produces its output via any kind of video output format, e.g., VGA, DVI, HDMI, display port, or any other form.

When operated on a computer, the computer may include a processor that operates to accept user commands, execute instructions and produce output based on those instructions. The processor is preferably connected to a communication bus. The communication bus may include a data channel for facilitating information transfer between storage and other peripheral components of the computer system. The communication bus further may provide a set of signals used for communication with the processor, including a data bus, address bus, and/or control bus.

The communication bus may comprise any standard or non-standard bus architecture such as, for example, bus architectures compliant with industry standard architecture ("ISA"), extended industry standard architecture ("EISA"), Micro Channel Architecture ("MCA"), peripheral component interconnect ("PCI") local bus, or any old or new standard promulgated by the Institute of Electrical and Electronics Engineers ("IEEE") including IEEE 488 general-purpose interface bus ("GPIB"), and the like.

A computer system used according to the present application preferably includes a main memory and may also include a secondary memory. The main memory provides storage of instructions and data for programs executing on the processor. The main memory is typically semiconductor-based memory such as dynamic random access memory ("DRAM") and/or static random access memory ("SRAM"). The secondary memory may optionally include a hard disk drive and/or a solid state memory and/or removable storage drive for example an external hard drive, thumb drive, a digital versatile disc ("DVD") drive, etc.

A least one possible storage medium is preferably a computer readable medium having stored thereon computer executable code (i.e., software) and/or data thereon in a non-transitory form. The computer software or data stored on the removable storage medium is read into the computer system as electrical communication signals.

The computer system may also include a communication interface. The communication interface allows' software and data to be transferred between computer system and external devices (e.g. printers), networks, or information sources. For example, computer software or executable code may be transferred to computer system 550 from a network server via communication interface. The communication interface may be a wired network card, or a Wireless, e.g., Wifi network card.

Software and data transferred via the communication interface are generally in the form of electrical communication signals.

Computer executable code (i.e., computer programs or software) are stored in the memory and/or received via communication interface and executed as received. The code can be compiled code or interpreted code or website code, or any other kind of code.

A "computer readable medium" can be any media used to provide computer executable code (e.g., software and computer programs and website pages), e.g., hard drive, USB drive or other. The software, when executed by the processor, preferably causes the processor to perform the inventive features and functions previously described herein.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

Also, the inventors intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A mobile telephone comprising:

a control part, accepting commands from a user, and carrying out the commands by taking an action on the mobile telephone responsive to the commands;

a wireless communication part that communicates information indicative of the commands to a remote device;

a connection to a battery, operating said control part and said wireless communication part;

a battery monitor that monitors a charge level of the battery, wherein information indicative of said charge level of the battery is communicated to said remote device by said wireless communication part; and a processing part that receives said charge level, detects a battery voltage lower than a specified amount as said charge level, and wherein said information indicative of said charge level comprises an indication that the battery voltage is lower than the specified amount, wherein said wireless communication part also receives information, wherein said wireless communication part sends said information indicative of the charge level multiple times until receiving an indication that the information has been received by the remote device, and wherein said wireless communication part also obtains a remaining time that the mobile telephone can operate and displays information on the display about a remaining time that the mobile telephone can operate.

2. A device as in claim 1, wherein said wireless communication part communicates via radio frequency.

3. A device as in claim 1, wherein said wireless communication part communicates via infrared.

4. A device as in claim 3, wherein said wireless communication part sends information indicative of the charge level of the battery as part of a communication that is used to send a command to the remote device, at a time after a charge level of the battery reaches a specified amount.

5. A device as in claim 1, wherein said wireless communication part sends information indicative of the charge level of the battery at a time when the remote device is not displaying.

6. A device as in claim 1, wherein said mobile telephone includes a remote control.

7. A device as in claim 1, wherein said mobile telephone is a cellular phone.

8. A method of controlling and communicating battery information in a mobile telephone, comprising:

accepting commands from a user, and carrying out the commands by taking an action on the mobile telephone responsive to the commands;

communicating information indicative of the commands from the mobile telephone to a remote device;

operating said accepting and said communicating based on a battery power in the mobile telephone;

monitoring a charge level of a battery by detecting a battery voltage lower than a specified amount, and wherein said information indicative of said charge level comprises an indication that the battery voltage is lower than the specified amount; and communicating information indicative of said charge level of the battery from said mobile device;

receiving information from the remote device;

said communicating comprising sending said information indicative of the charge level multiple times until receiving an indication in the mobile device that the notification has been received; and determining a remaining time that the mobile telephone can operate and displaying information on the display about a remaining time that the mobile telephone can operate.

9. A method as in claim 8, wherein said communicating is via radio frequency.

10. A method as in claim 8, wherein said communicating is via infrared.

11. A method as in claim 10, wherein said information indicative of the charge level of the battery is received as part of a communication that is used to send a command to the mobile device, at a time after a charge level of the battery reaches a specified amount.

12. A method as in claim 8, further comprising sending information indicative of the charge level of the battery at a time when the remote device is not displaying.

13. A method as in claim 8, wherein said mobile telephone includes a remote control.

* * * * *